US006032818A

United States Patent [19]

Olson

[11] Patent Number: 6,032,818

[45] Date of Patent: Mar. 7, 2000

[54] LINER

[75] Inventor: Åke Olson, Stockholm, Sweden

[73] Assignee: Alfapac AB, Sweden

[21] Appl. No.: 09/142,566

[22] PCT Filed: Feb. 14, 1997

[86] PCT No.: PCT/SE97/00250

§ 371 Date: Sep. 15, 1998

§ 102(e) Date: Sep. 15, 1998

[87] PCT Pub. No.: WO97/34794

PCT Pub. Date: Sep. 25, 1997

[30] Foreign Application Priority Data

Mar. 21, 1996 [SE] Sweden ..... 9601092

[51] Int. Cl.[7] ..... B65D 88/12

[52] U.S. Cl. ..... 220/495.06; 220/459.01; 383/120

[58] Field of Search ..... 220/495.01, 495.06, 220/1.6; 383/120

[56] References Cited

U.S. PATENT DOCUMENTS

| | | | |
|---|---|---|---|
| 4,450,180 | 5/1984 | Watkins | 383/120 |
| 4,783,178 | 11/1988 | Herder | 383/120 |
| 4,974,966 | 12/1990 | Fabbi | 383/120 |
| 5,005,726 | 4/1991 | Robbins | 220/495.06 |
| 5,028,197 | 7/1991 | Krein et al. | 220/495.06 |
| 5,059,084 | 10/1991 | Krein | 220/495.06 |
| 5,188,460 | 2/1993 | Dorse | 220/495.06 |
| 5,344,048 | 9/1994 | Bonerb | 383/120 |
| 5,673,664 | 10/1997 | Lassanske | 220/495.06 |
| 5,865,541 | 2/1999 | Lafleur | 383/120 |

*Primary Examiner*—Joseph M. Moy

*Attorney, Agent, or Firm*—Ostrolenk, Faber, Gerb & Soffen, LLP

[57] ABSTRACT

A liner (1) intended as inner packing in a container (11) for holding a fluid, comprising an upper (2) and a lower (3) rectangular web of essentially the same length and width, which are made of a flexible material and which are joined (4) to each other along portions of their outer edges (8, 9, 34), and at least one sealable opening (5, 6) in one of the webs (3) for filling the liner (1) with said fluid and then emptying the liner of said fluid in the container (11). The novelty of the invention is that the liner integrally comprises a pair of flap members (41, 42) at one of the outer edges (33) between the webs (2, 3), that one flap member (41) has been folded over the upper web (2), that the corner portions (13) of the liner adjacent to the essentially unfolded flap member (42) have been folded towards the center over the upper web (2), and that the liner (1) has been folded symmetrically at least twice towards the symmetry line (7) over the upper web (2). The invention also relates to the use of the liner with a container.

11 Claims, 7 Drawing Sheets

LINER

Figure 1:
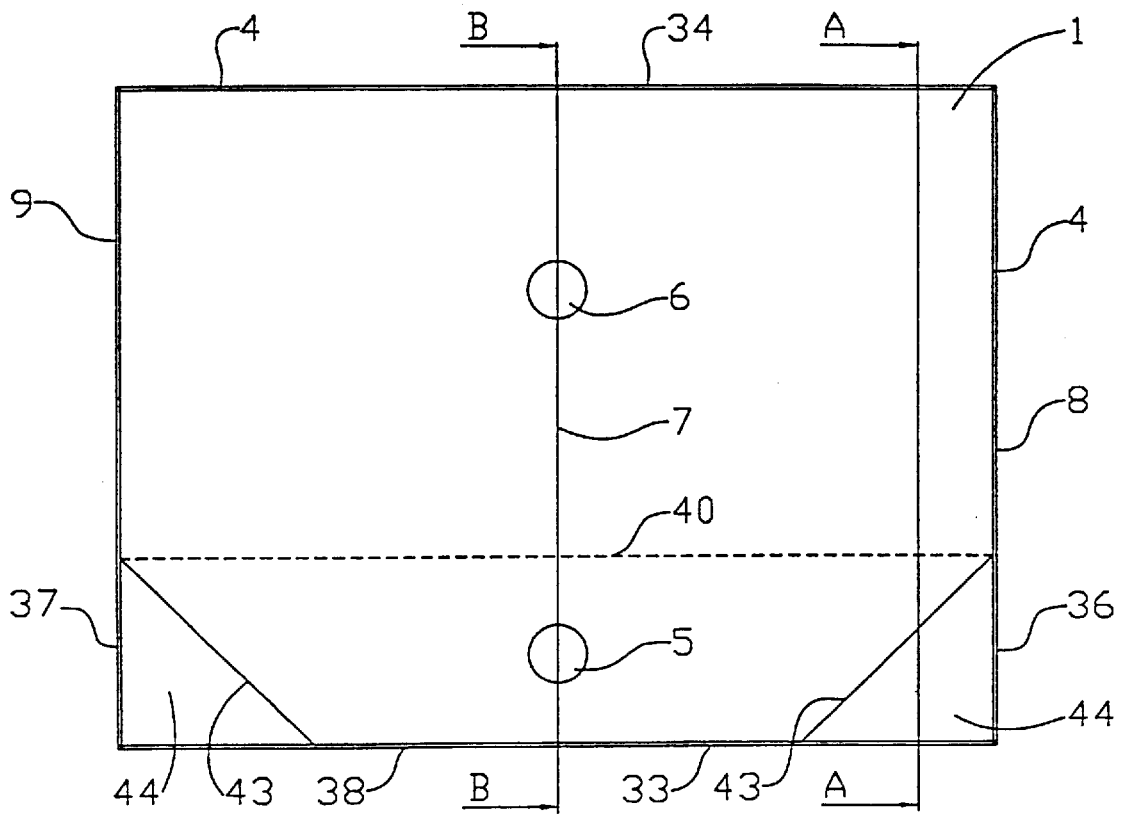

The present invention relates to a liner intended as inner packing in a container for holding a fluid, comprising an upper and a lower rectangular web of essentially the same length and width, which are made of a flexible material and are joined to each other along their outer edges, and at least one sealable opening in one of the webs for filling the liner with said fluid and then emptying the liner of said fluid in the container. Each sealable opening is arranged in the same rectangular web near the respective outer edge in a first pair of the opposite outer edges of the webs and on a symmetry line of the web, which is orientated parallel to and equidistantly from a second pair of the opposite outer edges of the webs. The invention also relates to its use as inner packing in a container for holding a fluid.

It is known to transport and store fluids in a liner intended as inner packing in collapsible containers of the 500–1000 liter (0.5–1.0 $m^3$) size. These containers provide the industry with the following logistical advantages:

No cleaning—a new inner liner is fitted in connection with each new filling.

Reduced transportation costs, less storage space—folds to one third of its size and is stable during stacking both when filled up and when empty.

Despite the fact that the industry sees certain advantages in using an inner liner, there is a reluctance to increase handling in connection with filling because of the complicated fitting of an inner liner. Customers who use inner liners today often need to fill the liner with air first in order for it to settle into place in the container. When the product filling starts, the air has to be evacuated at the same rate as the filling is being effected.

A liner as set forth above is known from WO 93/24389. All the corner portions of the known liner have been folded so that each corner portion has been applied over the web which does not exhibit the sealable openings adjacent to, but not overlapping them. Furthermore, the liner folded in this manner has been rolled up from a pair of opposite outer edges of the liner and up to the sealable openings. Subsequent to the raising of the container, onto which the liner previously has been attached, the liner is filled with a fluid through the upper opening. In this connection, there is a risk that the fluid, especially if it is viscous, does not flow down to the lowest portion of the liner which rests against the bottom of the container. Instead, the lowest vertical portion of the liner will be formed by the fluid into an expanding bulge which settles over the lowest portion and effectively prevents the fluid from filling it. Because of this "tying off", the container can only be partially filled with the fluid, since a part of the liner "is missing". In addition, the design of the liner—the liner is constructed of only two rectangular webs joined to each other along their outer edges—results in difficulty in filling the corner portions of the liner, and in the liner being unable to adjust optimally to the shape of the container.

The object of the present invention is to provide a liner intended as inner packing in a container for holding a fluid, which allows simple and safe mounting of the liner in the container, and with a good fit.

Another object of the invention is to provide an inner packing for a fluid in a container, which allows quick, reliable, and hermetic filling of the container with the fluid and without requiring any deaeration of the inner packing.

According to the invention, these objects are achieved by a liner according to the opening paragraph, which is characterised in that at least one doubled web is arranged between the rectangular webs and is joined by its outer edge portions to the upper rectangular and the lower rectangular web, whereby two superposed flap members are formed which are open to the inside of the inner packing and whose outer edge portions are parallel to and aligned with the outer edges of the rectangular webs, and that the rectangular webs are joined to each other along their outer edges which are located opposite the flap members and along their outer edges which are parallel to said symmetry line, from the first-mentioned outer edges and at least up to the folding line of the flap members, and that the liner is prepared in the following steps:

(A) one flap member of the liner has been folded so that it has been applied over the web which does not exhibit the sealable opening or openings, along the folding line of the flap members;

(B) the two corner portions of the liner adjacent to the other essentially unfolded flap member have been folded such that each corner portion has been applied over the web which does not exhibit the sealable opening or openings, up to but not overlapping said symmetry line;

(C) the liner folded in this manner has been folded along a pair of folding lines, which are parallel to the symmetry line and which are orientated essentially equidistantly from and on each side of the symmetry line, so that each outer edge portion remaining in step (B) does not overlap the symmetry line, over the web of the liner which does not exhibit the sealable opening or openings.

The use of the liner according to the invention as inner packing in a container for holding a fluid comprises the features that the first sealable opening is fixed in an associated hole at a lower edge portion in the container and on a symmetry line in the wall or bottom of the container, which forms said edge portion, the symmetry line being orientated parallel to and equidistantly from the edges of the wall or of the bottom, which extend from said edge portion, that the liner's second sealable opening is fixed in an associated hole in the top of the container at an upper edge portion of the container, formed by said wall, and on a symmetry line, orientated parallel to said symmetry line and along the centre portion of the top and that, when the liner is being filled through one of said sealable openings, the tube-shaped cover is caused to move by means of the expansion of the liner in the direction of the second sealable opening in order to, in the final stage, be forced off the inner packing and be arranged between the inner packing and the top of the container, around the second sealable opening.

Further developments of the invention can be seen from the features stated in the subclaims.

Figure 2:
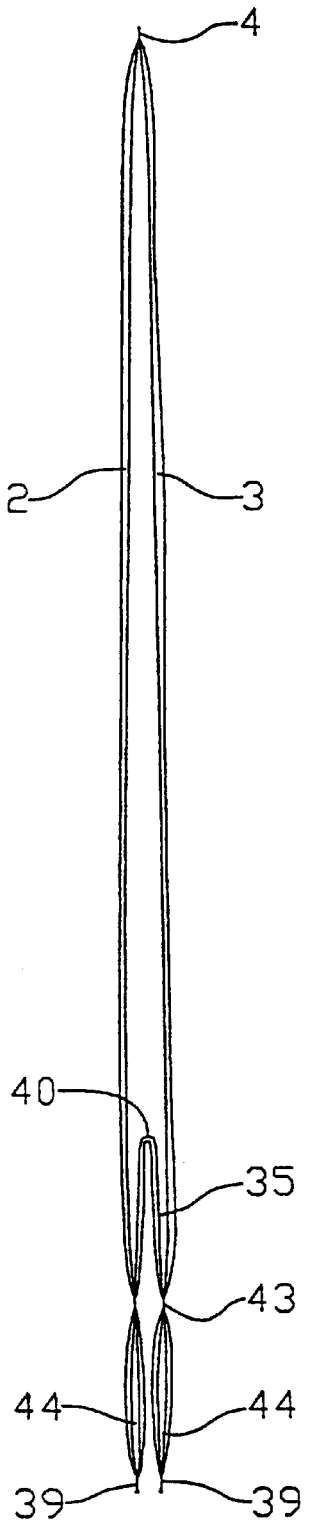
Figure 3:
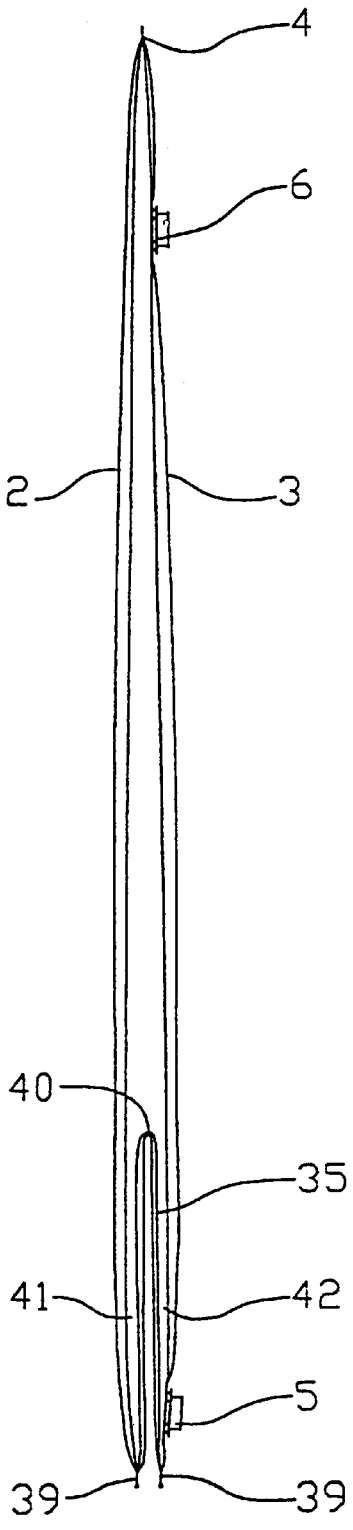
Figure 4:
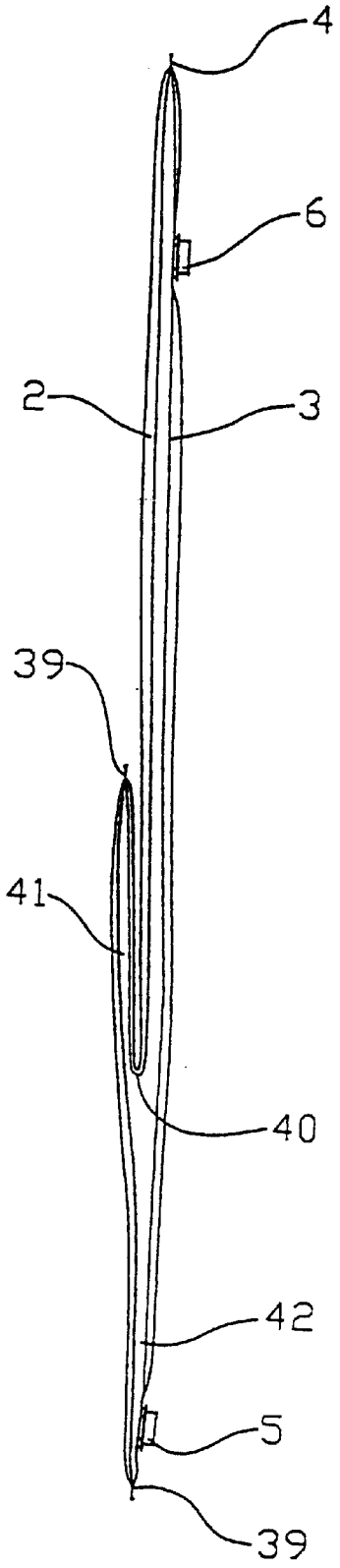
Figure 5:
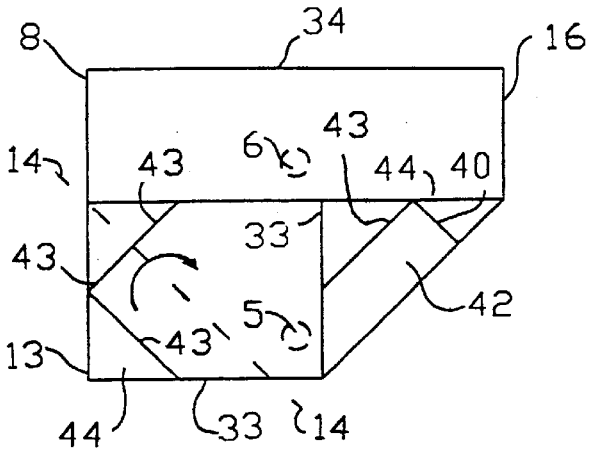
Figure 6A:
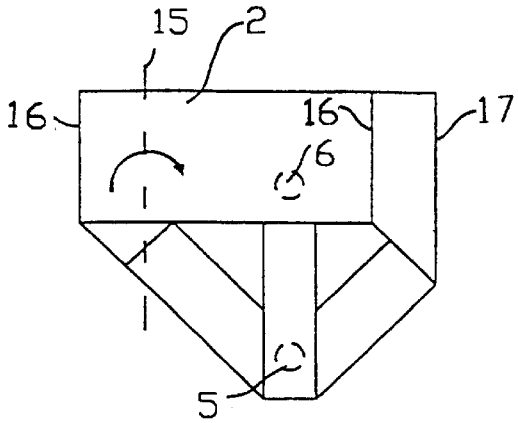
Figure 6B:
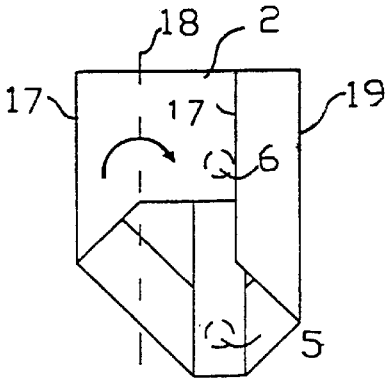
Figure 6C:
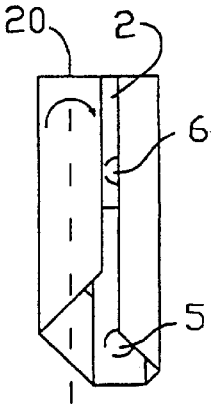
Figure 6D:
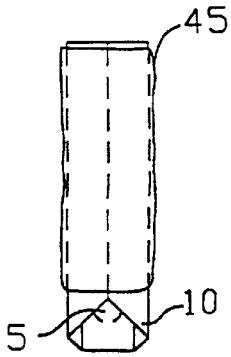
Figure 9A:
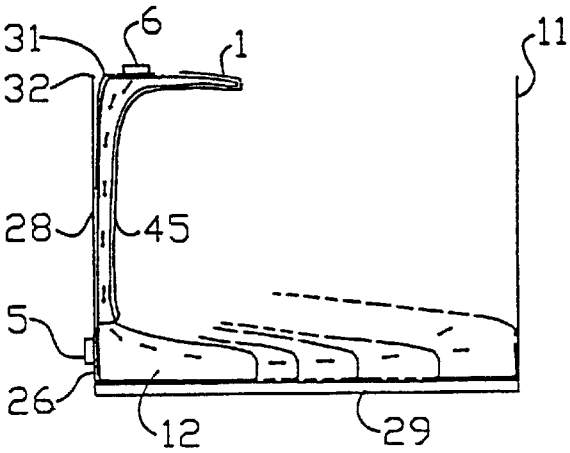
Figure 9D:
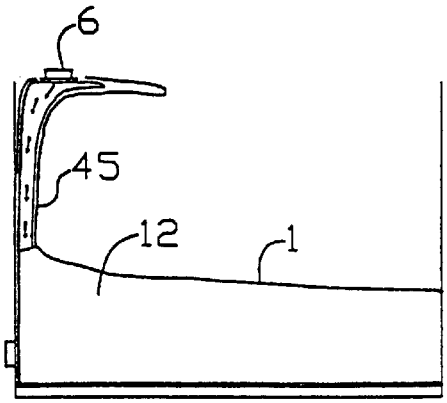
Figure 9B:
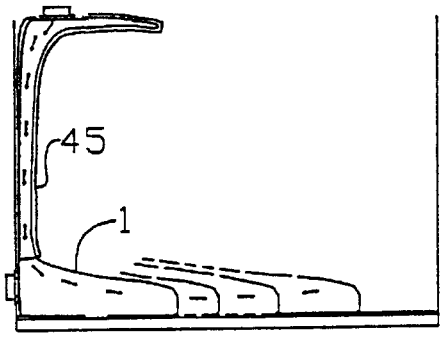
Figure 9E:
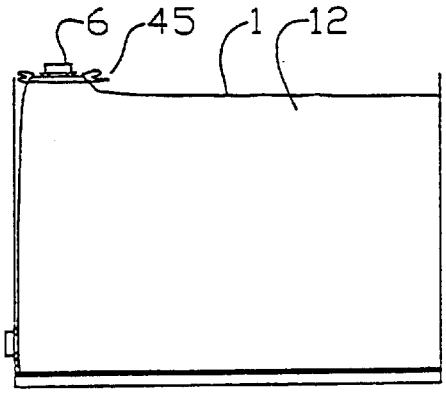
Figure 9C:
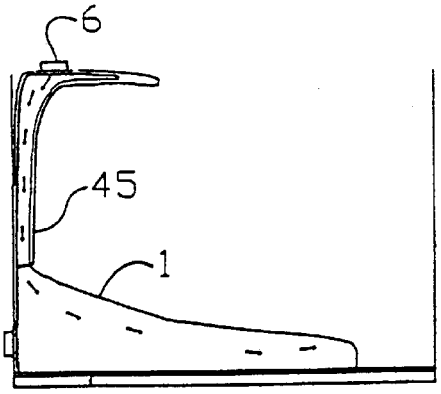
Figure 9F:
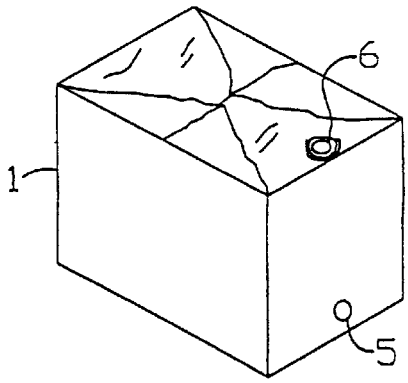

By way of example, preferred embodiments of the invention will now be described in more detail with reference to the accompanying drawings, in which:

FIG. 1 is a top view of the liner arranged on a flat surface with the sealable openings facing upwards, FIG. 2 schematically, and on an enlarged scale, illustrates a section through the liner along the line A—A, FIG. 3 schematically, and on an enlarged scale, illustrates a section through the liner along its symmetry line, the line B—B, FIG. 4 schematically, and in a section similar to that in FIG. 3, shows one of the flap members of the liner folded back over the liner, FIG. 5; left part, indicates the folding line along which one corner portion of the liner is folded over the liner, while the right part shows the opposite corner portion folded over, FIGS. 6*a*–6*d* illustrate in sequence how the liner is folded over itself along folding lines which are parallel to its symmetry line, and, in addition, FIG. 6*d* shows that an optional tube-shaped cover has been arranged over the folded inner packing as a final step, FIGS. 7*a*–7*d* show some alternative embodiments of the liner, FIGS. 8*a*–8*d* illustrate what these embodiments look like when one flap member of the liner has been folded back over the liner, as shown in FIG. 4, FIGS. 9*a*–9*e* illustrate in sequence how the liner, used as inner packing in a container, is filled and the tube-shaped cover is moved towards a sealable opening, and FIG. 9*f* shows the filled liner inside the container.

Referring first to FIGS. 1, 2 and 3, a liner 1 according to the invention comprises one upper and one lower, rectangular or square web 2, 3 made of an elastic material. The webs, which are of essentially the same length and width, preferably consist of a number of layers of film, for example PE-film, and are joined to each other by means of continuous welds 4 along portions of their outer edges, so that an open pocket is formed. In one web 3 two sealable openings 5 and 6 are arranged at a considerable distance from each other and on a symmetry line 7 in the web 3, which is orientated parallel to and equidistantly from one pair of joined outer edges 8 and 9 of the webs. Thus, two sealable openings are arranged adjacent to another pair of outer edges 33 and 34 of the webs, but, if desired, one of the openings can be eliminated, leaving only one sealable opening, for example the opening 6 adjacent to the outer edge 34. The sealable openings 5 and 6, which serve as inlet and outlet openings for the supplying and emptying of a liquid or pulverulent medium, preferably consist of non-yielding pipe joints or pipe sockets made of thermoplastic material, which are fixed in prepunched holes in one web 3 preferably by means of continuous welds so that a hermetically sealed liner is achieved. The sides, the inlet and outlet openings are homogenised by means of heat treatment and compression. The liner is intended for use as inner packing 10 in a collapsible container 11 (see FIG. 9) for holding the fluid 12 which is to be stored and/or transported in the container 11 without contaminating the latter. After use, the inner packing 10 can be replaced by an unused packing which can be used in the same non-contaminated container. The filling can be effected by the direct connection of a tube (not shown) to one of the sealable openings without the surrounding environment being contaminated.

Adjacent to one of the outer edges, for example the outer edge 33, a doubled web 35 is inserted between the rectangular webs 2 and 3. The doubled web 35 is joined by its outer edge portions 36–38 to the outer edges 8, 9, and 33 of the upper and lower webs 2, 3, as is shown best in FIG. 3. Preferably, the web 35 is made of the same material as the webs 2 and 3 and can be formed integrally with these webs. In the embodiment shown, the web 35, however, is a separate web which is joined to the surrounding webs 2 and 3 by means of continuous welds 39. As seen in FIG. 1, the folding line 40 of the web 35 is parallel to the outer edge portions 33 and 34, perpendicular to the symmetry line 7 and is arranged between the outer edge portion 33 and the centre of the liner 1. Thus, the web 35 and the webs 2 and 3 form two superposed identical flap members 41 and 42, one 41 sealed against the web 2 and the other 42 sealed against the web 3, cf. FIG. 3. The webs 2 and 3 are thus directly joined to each other along the outer edge 34 and along the outer edges 8 and 9 from the outer edge 34 up to the folding line 40. Along their remaining outer edges 8 and 9 and along the outer edge 33, the webs 2 and 3 are joined to each other by the intermediary of the web 35. In this way, a leak-proof pocket is formed with two flap members, which are open to the inside of the inner packing 10 (the liner 1). It is, of course, also possible to arrange a doubled web at the outer edge 34 in the manner stated above. Finally, FIGS. 1 and 2 show that both corners of each flap member 41 and 42 are sealed by means of an associated weld 43, which connects the opposite portions of each flap member 41 and 42 to each other. The welds 43 extend from the intersectional point between the folding line 40 and the outer edges 8 and 9 respectively up to the outer edges 33, preferably at an angle of 45° to said outer edges. As a result, two pairs of lugs 44 sealed against the inside of the liner 1 are formed, something which facilitates the filling of the inner packing 10.

In addition to exhibiting the above design, in order for the liner to be able to be easily and safely fitted and hermetically filled with a fluid in a container, it has to be folded in a particular manner, which will now be described in more detail.

FIG. 4 shows that the first folding step comprises the folding of the one flap member 41 along said folding line 40 so that it rests on the web 2 which does not exhibit the sealable opening or openings 5, 6. The other flap member 42 remains unfolded.

In the next folding step, shown in FIG. 5, the liner corner portions 13 adjacent to the flap member 42 are folded from the state shown in the left part of the figure over the upper web 2 along their respective folding lines 14, which form an angle (preferably 45°) with each outer edge 8 and 9, so that the corner portions are moved adjacent to but do not overlap the symmetry line 7, as shown in the right part of the figure.

In this state, which is also shown in FIG. 6*a*, left part, the liner is subsequently folded along a pair of folding lines 15, which are parallel to the symmetry line 7 and which are orientated essentially equidistantly from and on each side of the symmetry line, over the web 2; cf. the right part of FIG. 6*a*. The outer edge portions 16 remaining after the previous folding step, see FIG. 5, should not overlap the symmetry line 7. The folding line 15 can be orientated essentially equidistantly from the symmetry line 7 and the two outer edges 8 and 9, but preferably the folding line is arranged considerably closer to the outer edges, so that the new outer edge portions 17 can be folded along a further pair of folding lines 18, i.e. from the state shown in FIG. 6*b*, left part, to the state according to the right part of the figures. These are also parallel to the symmetry line 7 and are orientated at a distance from the new outer edge portions 17 obtained by the previous folding, which essentially corresponds to the distance between said outer edge portions 16 and 17. This folding is also carried out over said web 2, as shown in the right part of FIG. 6*b*, and so that the outer edge portions 17 do not overlap the symmetry line 7. This folding procedure is repeated preferably until the penultimate outer edge portions 19 have been folded along the folding lines 20 over the web 2 and been moved up to, but not overlapping the symmetry line 7, as shown in FIG. 6*c*. The appearance of the ready-folded liner can be seen in FIG. 6*d*. In this figure, it is also shown that the liner preferably, but not compulsorily, comprises a flexible, tube-shaped cover 45 surrounding the folded inner packing 10 and exhibiting a length less than that of the inner packing. In the embodiment shown the cover 45, which preferably is made of the same material as the webs 2, 3 and 35, extends from just above the opening 5 and over the opening 6, which projects through a hole (not shown) made in the cover. In addition to keeping the folded inner packing 10 together, the cover 45 facilitates the filling of the inner packing, as stated below.

Figure 7B:
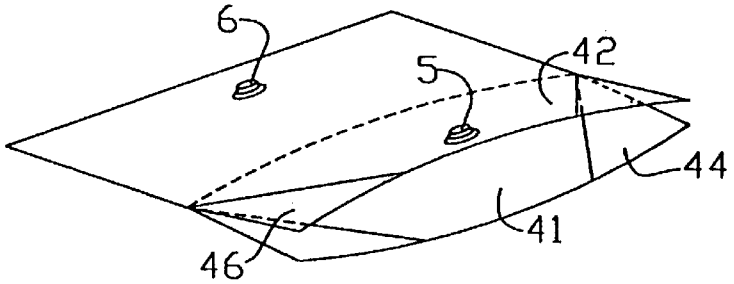
Figure 7D:
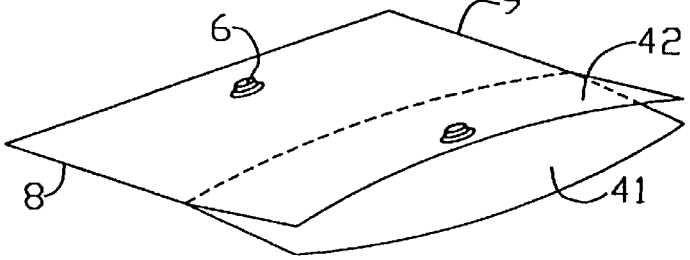
Figure 7A:
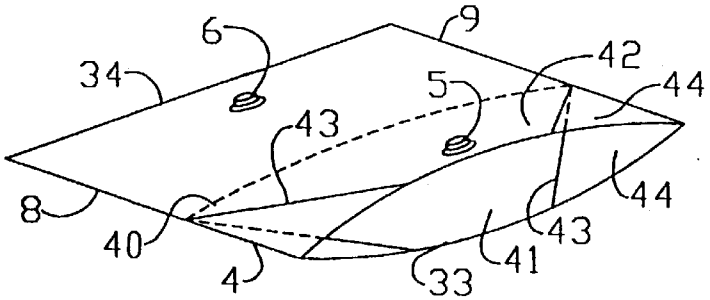
Figure 7C:
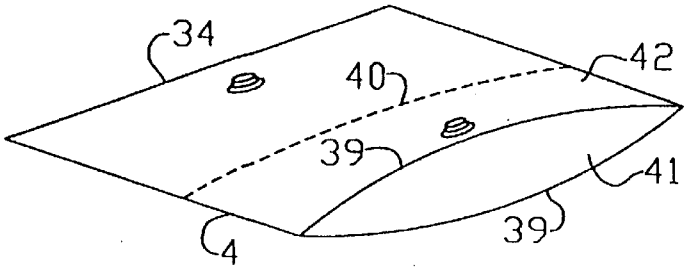
Figure 8B:
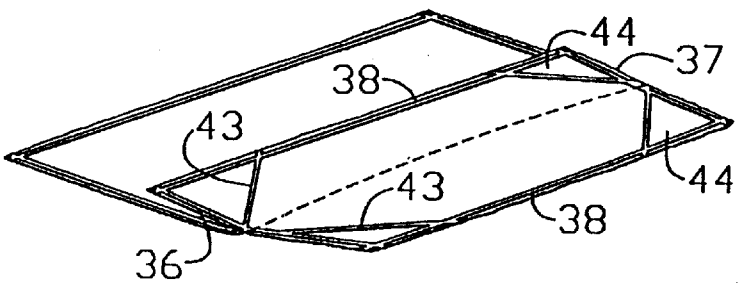
Figure 8D:
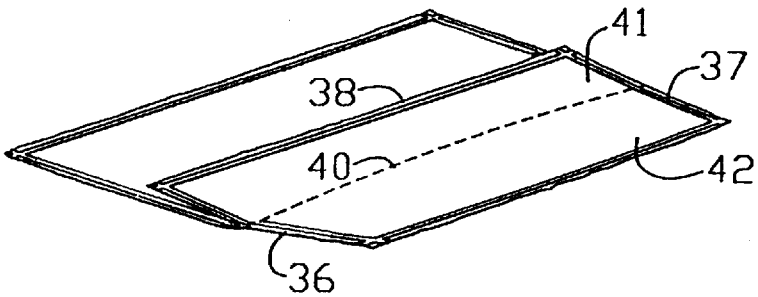
Figure 8A:
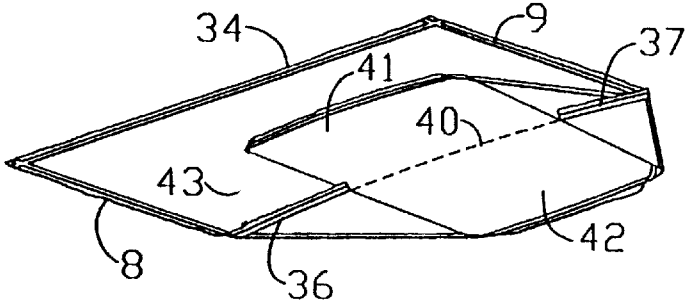
Figure 8C:
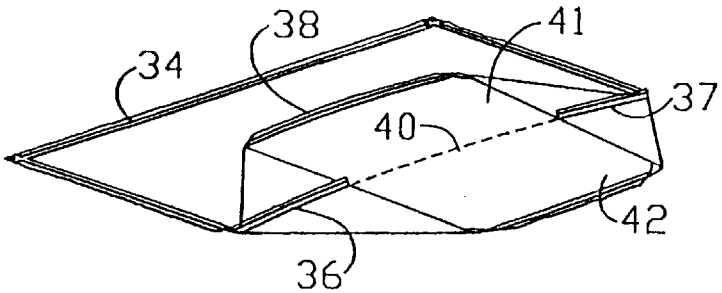

Reference is now made to FIGS. 7*a*–7*d* which show alternative embodiments of the liner according to the invention. FIG. 7*b* is the embodiment discussed above, FIG. 7*a* shows an embodiment which differs from the above-mentioned embodiment only by the fact that the welds 4 along the outer edges 8 and 9 do not stop at the folding line 40 but extend from the outer edges 34 up to the outer edges 33. The embodiments according to FIGS. 7*c* and 7*d* are identical to the embodiments according to FIGS. 7*a* and 7*b*, except that the lugs 44 are missing.

FIGS. 8*a*–8*d* show the respective embodiments according to FIGS. 7*a*–7*d* after the first folding step, i.e. as illustrated in FIG. 4, when one flap member 41 has been folded over the web 2 which does not exhibit the sealable opening or openings. The other flap member 42 remains unfolded in the embodiments according to FIGS. 7*b*–8*b* and FIGS. 7*d*–8*d*, while the corners of the flap member 42 have been folded over said flap member against the folding line 40 in the embodiments according to FIGS. 7*a*–8*a* and FIGS. 7*c*–8*c*. Nevertheless, the second folding step is effected in the manner illustrated in FIG. 5, i.e. the two corner portions 13 are folded in.

With reference to FIGS. 9*a*–9*e*, the use of the liner as inner packing and its being filled with a fluid will now be schematically illustrated in sequence.

Subsequent to the raising of the container 11, the sealable opening 5, which is arranged on the outside of the liner 1 according to FIG. 9, is fixed in a hole 26 intended for this purpose at a lower edge portion 27 of the container 11 and on a symmetry line (not shown) in the wall 28 or the bottom 29 of the container, which forms said edge portion 27. The symmetry line is orientated parallel to and equidistantly from the edges of the wall 28 or of the bottom 29 which extend from the edge portion 27. Subsequently, the second, sealable opening 6 is fixed in a hole intended for this purpose in the top 31 of the container at an upper edge portion 32, or in a clamp or the like (not shown) projecting from the upper portion of the wall 28, and on a symmetry line (not shown), which is orientated parallel to and above the above-mentioned symmetry line along the centre portion of the top 31. The filling of the liner 1 with a liquid or pulverulent product can now take place, without previous filling with air, by the connection of a filler tube (not shown) to the sealable opening 6 (or 5). As the liner (the inner packing) is being filled with a fluid under pressure 12 (as indicated by the arrows in the figure), it will unfold symmetrically from the symmetry line 7 of the liner, whereby, if applicable, as the liner 1 expands, the tube-shaped cover 45 is caused to slide on the outside of the liner towards the opening 6 and to be compressed into folds (bunch up). In this connection, the cover 45 forms a constriction which forces the fluid into the free liner portion at the bottom 29 of the container for controlled filling. In the final stage of the filling, the cover 45 is forced off the liner 1 and ends up around the opening 6, see FIG. 9*e*, between the liner and the top of the container, and the liner abuts against all the walls, the bottom, and top of the container 11 and protects these against contamination. The filling is effected completely hermetically because the liner does not contain any air which has to be evacuated. The emptying of the liner preferably is effected through the lower opening 5. Finally, in FIG. 9, the filled liner 1 is illustrated inside the container 11, which is not shown in this figure. If there is only one sealable opening, this is fixed as described above with reference to the opening 6, and in this case, the emptying is effected through the same opening.

The invention is not limited to what is described above or shown in the drawings, but can be modified within the scope of the claims.

I claim:

1. A liner (1) intended as inner packing in a container (11) for holding a fluid, comprising an upper (2) and a lower (3) rectangular web of essentially the same length and width, which are made of a flexible material and are joined (4) to each other along portions of their outer edges (8, 9, 34), and at least one sealable opening (5, 6) in one of the webs (3) for filling the liner (1) with said fluid and then emptying the liner of said fluid in the container (11), each sealable opening (5, 6) being arranged in the same rectangular web (3) near the respective outer edges of a first pair of the opposite outer edges (33, 34) of the webs and on a symmetry line (7) of the web (3), which is orientated parallel to and equidistantly from a second pair of the opposite edges (8, 9) of the webs, characterised in that at least one doubled web (35) is arranged between the rectangular webs (2, 3) and is joined by its outer edge portions (36–38) to the upper and the lower rectangular web (2, 3), whereby two superposed flap members (41, 42) are formed which are open to the inside of the inner packing (10) and whose outer edge portions (36–38) are parallel to and aligned with the outer edges (8, 9, 34) of the rectangular webs (2, 3), and that the rectangular webs (2, 3) are joined to each other along their outer edges (34) which are located opposite the flap members (41, 42) and along their outer edges (8, 9) which are parallel to said symmetry line (7), from the first-mentioned outer edges (34) and at least up to the folding line (40) of the flap members, and that the liner (1) is made in the following steps:

(A) one flap member (41) of the liner has been folded so that it has been applied over the web (2) which does not exhibit the sealable opening or openings (5, 6), along the folding line (40) of the flap members;

(B) the two corner portions (13) of the liner adjacent to the other, essentially unfolded flap member (42) have been folded such that each corner portion (13) has been applied over the web (2) which does not exhibit the sealable opening or openings (5, 6), up to but not overlapping said symmetry line (7);

(C) the liner folded in this manner has been folded along a pair of folding lines (15), which are parallel to the symmetry line (7) and which are orientated essentially equidistantly from and on each side of the symmetry line, so that each outer edge portion (16) remaining in step (B) does not overlap the symmetry line (7), over the web (2) of the liner which does not exhibit the sealable opening or openings (5, 6).

2. A liner as set forth in claim 1, characterised in that the liner in step (C) has been folded along a pair of folding lines (18) which are orientated closer to the respective outer edge portions (17) than to the symmetry line (7), and that the liner has then been folded along a pair of folding lines (20), which are parallel to the symmetry line (7) and which are orientated at a distance from the new outer edge portions (17) obtained in step (C), which essentially corresponds to the length of the overlap formed in step (C), so that each outer edge portion (17) does not overlap the symmetry line (7), over the web (2) of the liner which does not exhibit the sealable opening or openings (5, 6).

3. A liner as set forth in claim 1, characterised in that the rectangular webs (2, 3) are joined to each other along their outer edges (34) which are located opposite the flap members (41, 42) and along their outer edges (8, 9) which are parallel to said symmetry line (7), from the first-mentioned outer edges (34) and up to the opposite outer edges (33).

4. A liner as set forth in claim 1, characterised in that each corner of the flap members (41, 42) is sealed by means of an associated sealing joint (43) connecting the opposite portions of each flap member (41, 42) to each other and extending from the intersectional point between the folding line (40) of the flap members and the respective outer edges (8, 9) of the webs, essentially at an angle of 45° to said outer edges (8, 9), up to the outer edge portion (33) of the associated flap member, which edge portion is orientated perpendicular to the symmetry line (7), so that two pairs of lugs (44) sealed against the inside of the inner packing are formed.

5. A liner as set forth in claim 1, characterised in that the doubled web (35) is formed integrally with the rectangular webs (2, 3).

6. A liner as set forth in claim 1, characterised in that each web (2, 3) comprises several layers of film.

7. A liner as set forth in claim 1, characterised in that the sealable openings (5, 6) comprise non-yielding pipe joints, which are fixed in prepunched holes in one web (3) by means of welds.

8. A liner as set forth in claim 1, characterised in that the webs are joined to each other by means of welds (4).

9. A liner as set forth in claim 1, characterised in that the liner (1) comprises a flexible tube-shaped cover (45), surrounding the folded inner packing (10) and exhibiting a length less than that of the folded inner packing.

10. A liner as set forth in claim 1, characterised in that the liner comprises two doubled webs (35) arranged at a pair of the opposite outer edges (33, 34) of the webs and perpendicular to said symmetry line (7).

11. Use of a liner (1) as set forth in claim 9, as inner packing (10) in a container (11) for holding a fluid, the first sealable opening (5) being fixed in an associated hole (26) at a lower edge portion (27) in the container (11) and on a symmetry line in the wall (28) or bottom (29) of the container, which forms said edge portion (27), the symmetry line being orientated parallel to and equidistantly from the edges of the wall (27) or of the bottom (29), which extend from said edge portion (27), that the second sealable opening (6) of the liner is fixed to an upper edge portion (32) in the container and on a symmetry line orientated parallel to said symmetry line and that, in connection with the filling of the liner through one of said sealable openings (5, 6), the tube-shaped cover (45) by the expansion of the liner is caused to move in the direction of the second sealable opening (6) in order to, in the final stage of the filling, be forced off the inner packing (10) and be arranged between the latter and the top (31) of the container, around the second sealable opening (6).

* * * * *